US007342539B2

(12) United States Patent
Rosenberg et al.

(10) Patent No.: US 7,342,539 B2
(45) Date of Patent: Mar. 11, 2008

(54) WIDEBAND LOOP ANTENNA

(75) Inventors: Hans Rosenberg, Dwingeloo (NL); Henrik Jidhage, Alingsas (SE); Bengt Svensson, Molndal (SE)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 10/533,033

(22) PCT Filed: Oct. 17, 2003

(86) PCT No.: PCT/EP03/11532

§ 371 (c)(1),
(2), (4) Date: Oct. 24, 2005

(87) PCT Pub. No.: WO2004/040697

PCT Pub. Date: May 13, 2004

(65) Prior Publication Data

US 2006/0109183 A1 May 25, 2006

Related U.S. Application Data

(60) Provisional application No. 60/424,400, filed on Nov. 7, 2002.

(30) Foreign Application Priority Data

Oct. 31, 2002 (EP) ..... 02024241

(51) Int. Cl.
*H01Q 1/24* (2006.01)

(52) U.S. Cl. ..... 343/702; 343/741; 343/866

(58) Field of Classification Search ..... 343/702, 343/741, 742, 866, 700 MS, 867
See application file for complete search history.

(56) References Cited

U.S. PATENT DOCUMENTS 5,300,937 A * 4/1994 Capp et al. ..... 343/702

(Continued)

FOREIGN PATENT DOCUMENTS

EP 1 206 000 A2 5/2002

(Continued)

OTHER PUBLICATIONS

International Preliminary Examination Report PCT/EP 03/11532, undated.

(Continued)

*Primary Examiner*—Tho Phan
(74) *Attorney, Agent, or Firm*—Myers, Bigel, Sibley & Sajovec, P.A.

(57) ABSTRACT

The present invention relates to a wireless communication device and an antenna arrangement in such a device, where a loop antenna element (18) comprises: a first section (20) provided in and extending a length in first plane, a second section (22) spaced from, provided in and extending a length in the first plane, a third section (24) in a second plane parallel to the first plane, aligned with the first and second sections, and a fourth (26) and a fifth section (28) interconnecting antenna sections in the first and second planes. The sections form a three-dimensional structure having a substantial two-dimensional extension in at least one of the first and second planes. The second section extends along the same line as the first section or has a curvature, which is a continuation of the curvature of the first section. Thereby a small wideband antenna requiring a small ground plane is obtained.

15 Claims, 2 Drawing Sheets

U.S. PATENT DOCUMENTS

| | | | | |
|---|---|---|---|---|
| 5,678,202 | A * | 10/1997 | Filimon et al. | 455/575.7 |
| 6,067,051 | A | 5/2000 | Terk et al. | |
| 6,188,371 | B1 * | 2/2001 | Li et al. | 343/866 |
| 6,225,952 | B1 | 5/2001 | Harano | |
| 6,307,517 | B1 * | 10/2001 | Lee | 343/741 |
| 6,697,025 | B2 * | 2/2004 | Koyanagi et al. | 343/741 |
| 2002/0018021 | A1 | 2/2002 | Koyanagi et al. | |

FOREIGN PATENT DOCUMENTS

| | | |
|---|---|---|
| GB | 692692 | 12/1948 |
| WO | WO 02/27862 | 4/2002 |

OTHER PUBLICATIONS

EP Communication Pursuant to Article 96(2) EPC, for EP Application No. 02 024 241.8, mailed Oct. 9, 2006.

Yongho Kim et al; *A Folded Loop Antenna System for Handsets Developed and Based on the Advanced Design Concept*; IEICE Trans. Commun. vol. E84-B, No. 9, Sep. 2001.

* cited by examiner

WIDEBAND LOOP ANTENNA

RELATED APPLICATIONS

The present application is a 35 U.S.C. § 371 national phase application of PCT International Application No. PCT/EP2003/011532, having an international filing date of Oct. 17, 2003 and claiming priority to European Patent Application No. 02024241.8, filed Oct. 31, 2002, and to U.S. Provisional Application No. 60/424,400 filed Nov. 7, 2002, the disclosures of which are incorporated herein by reference in their entireties. The above PCT International Application was published in the English language and has International Publication No. WO 04/040697 A1.

TECHNICAL FIELD OF THE INVENTION

The present invention relates to the field of antennas and more particularly to a wireless communication device including a loop antenna element as well as to an antenna arrangement for a wireless communication device.

DESCRIPTION OF RELATED ART

The antennas within the field of wireless communication devices, especially small such devices like devices to be used for short-range high frequency communication, for instance using the Bluetooth™ communication protocol, need to be small because of the small devices often used. Examples of normal Bluetooth™ devices are headsets and handsfree devices, which communicate with for instance a cellular phone using Bluetooth™. These devices thus often need to be small while at the same time being able to work within a certain frequency band and in the case of Bluetooth™ around 2 GHz or higher.

Typical antennas for these types of devices have up till now often been dipole antennas, monopole antennas and PIFA (Planar Inverted-F Antenna). These types of antennas do however have a number of drawbacks when used. For instance monopole and PIFA antennas need large ground planes, which makes it hard to provide a small device with good antenna characteristics. A dipole antenna on the other hand needs to be fairly long, which also makes it hard to combine with a small device like a headset.

There is also a significant loss of efficiency in these known devices when used near a human head. A degradation of the efficiency of ten times has been obtained, which is a serious drawback in relation to headsets.

In "A Folded Loop Antenna System for Handsets Developed and Based on the Advanced Design Concept", IEICE Trans. Commun., Vol. E84-B, No. 9 September 2001, p. 2468-2475 by Kyohel Fujimoto et. al., there is described a folded loop antenna structure for a cellular phone. One structure shown includes a small three-dimensional structure arranged to be provided at one end of a ground plane. The ground plane is here quite large in relation to the antenna structure. Another drawback with this antenna is that it is placed above the ground plane, thereby occupying valuable PCB space.

There is thus a need for new antenna solutions to be used in small portable communication devices, in which both the ground plane can be small and where the antenna does not take up too much space in the device.

SUMMARY OF THE INVENTION

The present invention is directed towards solving the problem of proving a small antenna, which only needs a small ground plane for obtaining a certain bandwidth and that provides a high efficiency near the human head.

Another problem that the present invention solves is to provide an antenna that is cheap to manufacture.

One object of the present invention is therefore to provide a wireless communication device, where a small antenna element which only needs a small ground plane for obtaining a certain bandwidth is provided and that provides a high efficiency near the human head.

According to a first aspect of the present invention, this object is achieved by a wireless communication device comprising:

a loop antenna element comprising:

a first section provided in and extending a length in a first plane, a second section spaced from and provided in and extending a length in the first plane, where the second section extends along the same line as the first section or has a curvature which is a continuation of the curvature of the first section, a third section provided in a second plane essentially parallel to the first plane and essentially aligned with the first and second sections, and a fourth and a fifth section interconnecting antenna sections provided in the first and second planes, wherein the antenna sections form a three-dimensional structure having a substantial two-dimensional extension in at least one of the first and second planes A second aspect of the present invention includes the features of the first aspect, wherein the three-dimensional structure at least partly encloses an area in the first plane where a component can be placed.

A third aspect of the present invention includes the features of the first aspect, wherein antenna sections in the first and second planes extend in more than one direction A fourth aspect of the present invention includes the features of the first aspect, further including a sixth and a seventh antenna section essentially aligned with each other and provided in the first and the second plane, respectively, where the sixth and seventh sections are generally perpendicular to at least parts of and connected to the first and third section, respectively.

A fifth aspect of the present invention includes the features of the fourth aspect, wherein the fourth section furthermore interconnects the sixth and seventh section.

A sixth aspect of the present invention includes the features of the fourth aspect, further including an eighth and a ninth antenna section essentially aligned with each other and provided in the first and the second plane, respectively, where the eighth and ninth sections are generally perpendicular to at least parts of and connected to the second and third sections, respectively.

A seventh aspect of the present invention includes the features of the sixth aspect, wherein the fifth section furthermore interconnects the seventh and eighth section.

An eighth aspect of the present invention includes the features of the first aspect, wherein the first section has a first feeding end and the second section has a second feeding end both provided in the first plane close to each other.

A ninth aspect of the present invention includes the features of the first aspect, wherein the length of the loop antenna corresponds to a full wavelength of a centre frequency in a desired frequency band.

A tenth aspect of the present invention includes the features of the first aspect, further comprising a printed circuit board including a ground plane and radio circuits for the loop antenna element, wherein the antenna element sections are bound by the printed circuit board.

An eleventh aspect of the present invention includes the features of the tenth aspect, wherein the antenna is provided along at least half of the perimeter of the printed circuit board.

Another problem that the present invention is directed towards is to provide a wireless communication device having an even better wideband performance and requiring an even smaller ground plane.

According to a twelfth aspect of the present invention including the features of the first aspect, this problem is solved by further including at least one passive antenna element in a third plane parallel to the first plane and provided on the other side of the first plane than the second plane for providing a resonating circuit or tuning element for the loop antenna.

A thirteenth aspect of the present invention includes the features of the first aspect, wherein the antenna sections are provided in the form of metallic strips, wires or a combination of both.

A fourteenth aspect of the present invention includes the features of the first aspect, wherein the device is a portable communication device.

A fifteenth aspect of the present invention includes the features of the fourteenth aspect, wherein the portable communication device is a headset.

Another object of the present invention is to provide an antenna arrangement, which is small and only needs a small ground plane for obtaining a certain bandwidth and that provides a high efficiency near the human head.

According to a sixteenth aspect of the present invention, this object is achieved by an antenna arrangement for a wireless communication device comprising:

a first section provided in and extending a length in a first plane, a second section spaced from and provided in and extending a length in the first plane, where the second section extends along the same line as the first section or has a curvature which is a continuation of the curvature of the first section, a third section provided in a second plane essentially parallel to the first plane and essentially aligned with the first and second sections, and a fourth and a fifth section interconnecting antenna sections provided in the first and second planes, wherein the antenna sections form a three-dimensional structure having a substantial two-dimensional extension in at least one of the first and second planes.

A seventeenth aspect of the present invention includes the features of the sixteenth aspect, wherein the three-dimensional structure at least partly encloses an area in the first plane where a component can be placed An eighteenth aspect of the present invention is directed towards providing an antenna arrangement that can be provided in the form of a component.

Therefore this eighteenth aspect comprises the features of the sixteenth aspect and further comprises a dielectric material on which the sections of the antenna element are provided, in order to produce a component that can be mounted on a printed circuit board.

The present invention has many advantages. In addition to providing small antenna size with a small required ground plane, it is cheap to manufacture. In addition to providing good antenna characteristics in a small device, it also provides ESD protection along the sides of the device where the antenna is provided. The present invention furthermore provides good antenna matching. It also does not loose as much efficiency near the head of a user as many other antennas do.

It should be emphasized that the term "comprises/comprising" when used in this specification is taken to specify the presence of stated features, integers, steps or components, but does not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

A wireless communication device according to the invention will now be described. It is preferred that the wireless communication device is also portable and small. It is also preferred that the device is a headset, which is a preferred variation of the invention. It is possible to provide it in any other type of small portable communication devices than headsets like hands-free devices, but the invention can equally as well be provided in any other type of portable communication device, like mobile phone or PDA or even a regular computer. The preferred type of device is a device for short length high frequency wireless communication like Bluetooth™.

Figure 1:
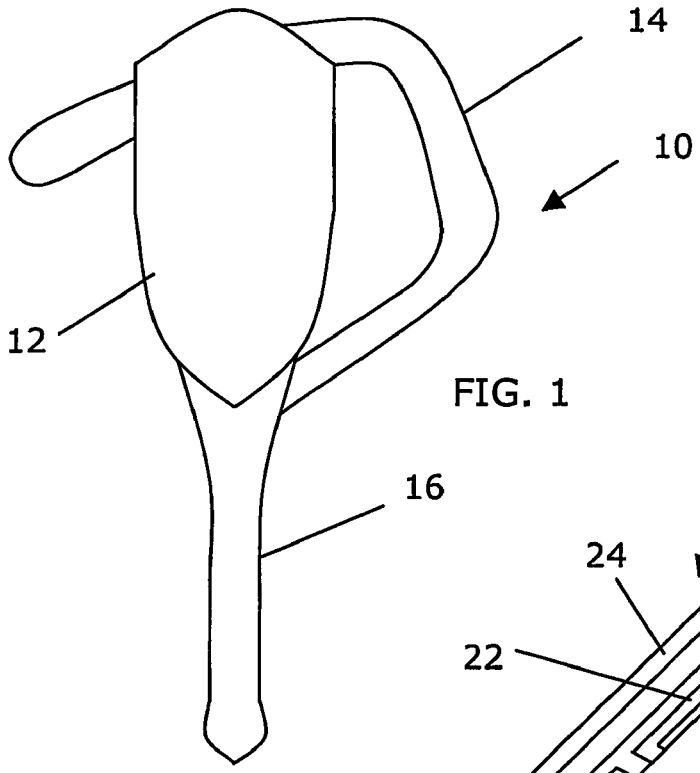
FIG. 1 schematically shows a wireless communication device according to the invention, FIG. 2 schematically shows a perspective view of the antenna arrangement according to a preferred embodiment of the invention together with some other components in the interior of the wireless communication device in FIG. 1, FIG. 3 schematically shows a top view of a printed circuit board from FIG. 2, FIG. 4 schematically shows a perspective view of a second embodiment of the antenna arrangement according to the invention, FIG. 5 schematically shows a perspective view of a third embodiment of the antenna arrangement according to the invention, FIG. 6 schematically shows a side view of the antenna arrangement according to the invention and provided with a parasitic resonating element, FIG. 7 schematically shows another side view of parts of the antenna arrangement together with a connection line, FIG. 8 schematically shows a top view of a component including the antenna element according to the first embodiment, and FIG. 9 schematically shows a bottom view of the component from FIG. 8.

FIG. 1 shows a schematical drawing of a headset 10 including a main body 12, a microphone part 16 and an ear fastener 14. The main body includes such things as radio circuits working according to the Bluetooth™ protocol, a battery and a speaker, all normal for this type of equipment.

Figure 2:
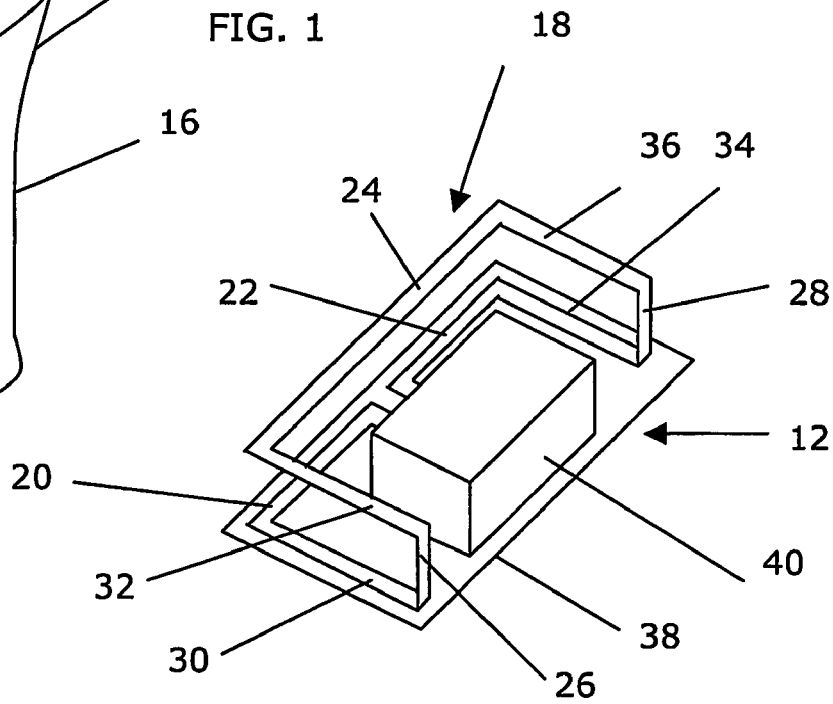

FIG. 2 shows a perspective view of the interior of the main body 12 including the parts relevant to the invention in a perspective view. The body comprises a printed circuit board (PCB) 38 on which is provided an antenna arrangement 18 or loop antenna element according to the invention as well as a battery 40. The PCB has a rectangular shape and here forms a first plane in which the antenna arrangement is provided. The PCB has a length, which is approximately a third of the wavelength used.

The antenna arrangement includes a first section 20 provided along a first half of one of the longest sides of the PCB, which section in a first feeding end is connected to the driving radio circuits (not shown). The end connected to the radio circuits is provided in the middle of the PCB side. A second section 22 is provided along a second half of the longest side of the PCB and is in a second feeding end connected to a grounding plane (not shown). The end connected to the grounding plane is also provided at the middle of the longest side. A third antenna section 24 is provided in a second plane above and parallel to the PCB. This section 24 is aligned with the first and second sections 20 and 22. It is thus parallel to the first and second sections. At an end of a first short side of the PCB provided at right angles to said longest side a fourth section 26 is provided for interconnecting antenna sections in the first and second planes. This fourth section 26 is provided at a corner most distanced from said longest side. At an end of a second short side furthest from said longest side a fifth section 28 is provided for interconnecting antenna sections in the first and the second plane. The second short side is provided at right angles to said longest side. A sixth section 30 is provided in the first plane along the first short side of the PCB and is connected to a second end of the first section 20 provided at the corner where said longest side and first short side meet. The sixth section is also connected to the fourth section 26. The sixth section is, as can be seen in the figure, perpendicular to the first section 20. A seventh section 32 is provided in the second plane aligned with the sixth section 30 and is connected between two ends of the third 24 and the fourth 26 section. The fourth section 26 is perpendicular to the sixth 30 and seventh 32 section and the seventh section 32 is perpendicular to the third section 24. In the same manner an eighth section 34 is provided in the first plane along the first short side of the PCB and is connected to a second end of the second section 22 provided at the corner where said longest side and second short side meet. The eighth section 34 is also connected to the fifth section 28. The eighth section 34 is perpendicular to the second section 22. A ninth section 36 is provided in the second plane aligned with the eighth section 34 and is connected between two ends of the third 24 and the fifth section 28. The fifth section 28 is perpendicular to the eighth 34 and ninth 36 section and the ninth section 36 is perpendicular to the third section 24. In this way an antenna loop is provided, which stretches in two different planes and which partly covers three out of the four sides of the PCB 38. The antenna arrangement thus has a three-dimensional structure, which partly encloses an area in the PCB where a component can be placed. The planes are spaced apart with a distance of at least about 2 mm, which guarantees a good bandwidth for the antenna. With this antenna arrangement the different sections of the antenna extend in three different directions, i.e. along one of the longest sides and along the two short sides and the antenna structure forms a rectangular box open at one side, within which components and batteries can be placed. The loop preferably has a length about equal to the wavelength used by the radio circuits. The antenna sections are provided in the form of thin metallic strips. The sections in the first plane are provided in the form of tracks formed in the PCB, while the sections in the second plane and the interconnecting sections are formed of sheet metal. It is however possible to provide the whole antenna structure in the form of sheet metal. It is also possible to provide parts or all of the antenna structure in the form of wires.

Figure 3:
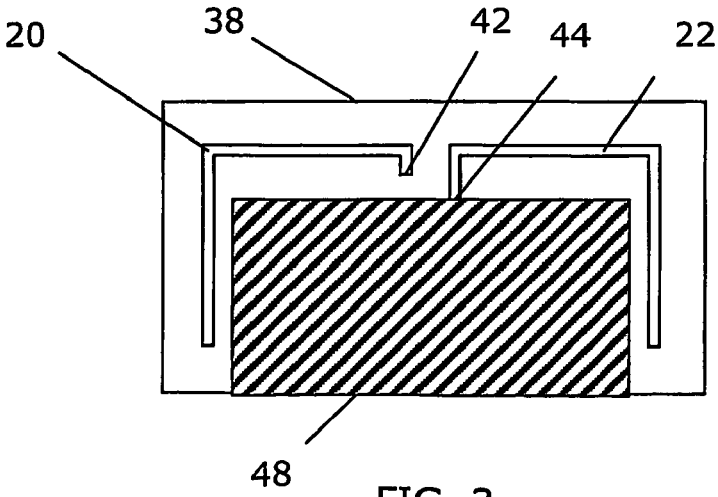

FIG. 3 shows a top view of the PCB and the antenna elements in the first layer. The battery and the other antenna elements are here omitted for better clarity. Here there is also shown a grounding layer 48 to which the second feeding end 44 of the second section 22 is connected. The first feeding end 42 of the first antenna element 20 is also shown. The ground layer is here provided on top of the PCB for clarity. It should however be realised that the ground layer can be provided anywhere in the PCB, like in a layer in the middle of the PCB or at the bottom of the PCB. The antenna structure here partly encircles the area of the ground plane. The feeding ends of the first and second section are shown having different lengths in order to show that one end is connected to ground, while the other is not, they can however have the same lengths. The radio circuits can be provided on top of the PCB or on the bottom side of the PCB. As an example the frequency band of the device according to the invention can be around 2 GHz or higher. By scaling of the whole structure it can however be used for any frequency. It should furthermore be realised that the second feeding end need not be connected to ground, but can be connected to another feeding voltage, which might be the opposite voltage fed to the first feeding end. The radio circuits can furthermore be connected between the first and second feeding-ends, without grounding the antenna.

With the described structure several advantages are obtained. Because of the structure of the antenna sections, the ground plane can be kept much smaller than for previous antenna designs, which in turn means that the device can be made smaller. This is a major advantage in Bluetooth™ related applications, like for instance earphones and headsets, where it is often desirable to keep the device as small as possible. The antenna structure does also not have any parts protruding outside of the PCB, which could otherwise be required for antennas, this also makes the device less bulky. Another advantage is that this structure is cheap to manufacture, since a big part of the antenna can be provided in the form of traces on the PCB and the rest as sheet metal. The structure furthermore protects against Electrostatic Discharge (ESD) on three sides of the device. This protects the enclosed components and makes the operation of the device more robust. Yet an advantage is that the antenna has much less severe performance degradation when used close to the head of a user than other known solutions. In some known solutions as much as 90% of the radiated power has been lost, while with the present solution as little as 50% is lost. Finally the antenna arrangement can be fed unbalanced where the feed end matches well with a 50-Ohm line without external matching.

Figure 4:
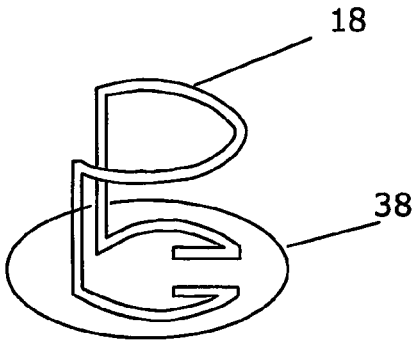
Figure 5:
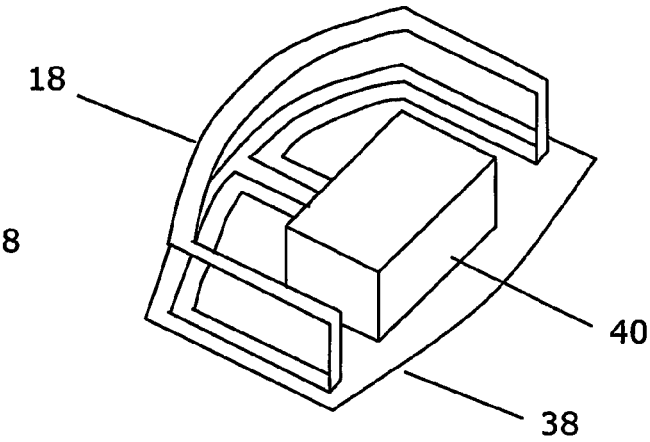

Now some variations of the antenna structure will be described in relation to FIGS. 4 and 5. FIG. 4 shows a perspective view of a second embodiment of a three-dimensional antenna arrangement 18 on a circular PCB 38. Here the antenna elements in the two planes are provided as parts of circles interconnected by interconnecting antenna sections. The sections are however interconnected in a similar manner as the sections of the first embodiment. Since the structure is circular, the curvature of the second section will here act as a continuation of the curvature of the first section. There are a few obvious variations to this embodiment. The sections can make up from half a circle to almost a full circle. The shape does also not have to be circular, but an elliptical shape is also possible. Another embodiment is shown in a perspective view in FIG. 5. This embodiment is similar to the embodiment in FIG. 2. Here the long sides of the PCB have a slight curvature, in order to provide a slight oval shape to the PCB. Also the antenna sections provided along the long sides are thus here provided with a similarly curved shape. Different curvatures are of course also feasible here. It is furthermore possible to also provide the sections along the short sides with curvature. Further possible variations to the first and third embodiments are to provide the antenna sections along just one long side and one short side as well as also providing antenna sections along the long side, which has been left open in FIG. 2, in addition to along the sides already provided with antenna sections. Here these sections can be provided just a bit along the fourth side up to almost all the length of the fourth side so that they almost touch. Another variation is to provide the feeding antenna sections along a short side and have antenna sections on both long sides beside this short side, thereby leaving one short side open. The antenna has been shown with a centred or symmetrical feeding. It is just as well possible to provide asymmetrical feeding. As can be seen in all embodiments, the loop antenna element is provided along at least half of the perimeter of the PCB. It should furthermore be realised that the two planes where the antenna elements are provided do not have to be exactly parallel. It thus suffices that they are essentially parallel. The third section does also not have to be exactly aligned with the first and second sections, but it suffices that it is essentially aligned. The sixth and seventh sections and the eighth and ninth sections do in the same way not have to be exactly aligned with each other. Nor do they have to be provided at exactly right angles to the first, second and third sections. The first and second sections can also have differing lengths. The different antenna sections need furthermore not be connected at the corners, but can be connected anywhere along a side of the PCB. The placing of the interconnecting points is decided by the desired length of the loop.

Figure 6:
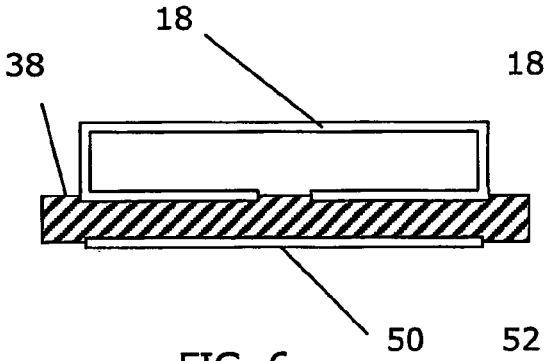

FIG. 6 shows yet another variation of the present invention. In FIG. 6 there is shown a side view from the longest side where the first and second antenna section is provided. The figure shows the antenna arrangement 18 from FIG. 2 provided on a top side of the PCB 38.

Here there is also provided a passive antenna element 50 in a third plane on the bottom side of the PCB aligned with the second and third sections and centred around the feed and grounding ends of these sections. The passive element 50 is floating in that it is not connected to feed or ground. With this element there is a parasitic capacitance between the rest of the antenna structure and the element in the third layer. These elements can be used for tuning of the antenna. With this structure a better broadband performance is achieved, which will make it possible to compensate for disturbances such as nearby metal parts, components or a human head. The element is aligned with the structure of the element in the first plane, so should another structure than a straight line be provided, the element will also have the same structure.

Figure 7:
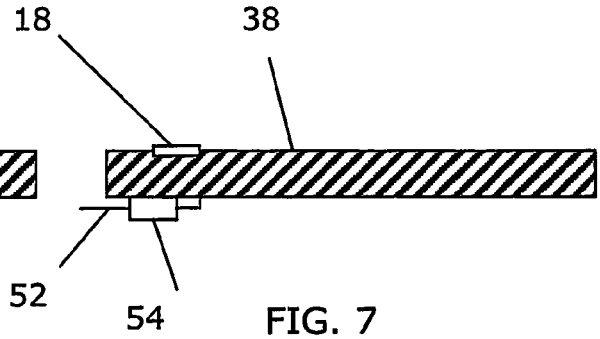

FIG. 7 shows another variation of the present invention. Here a side view from a longest side is shown. The figure shows part of the antenna structure 18 on the PCB 38. This figure also shows a lead 52 connected to the PCB 38 via an inductive component 54. The lead can be provided for such different things as microphone or speaker signals or battery charging. Because of the inductive circuit high frequency influence on the signals because of the radio transmission is limited. The inductive circuit thus functions as a sort of high-frequency filtering device.

There is yet another possible variation of the present invention and that is to provide the antenna arrangement according to the invention in the form of a component. Such components can for instance be a surface mount component that can be used in pick and place mounting schemes.

Figure 8:
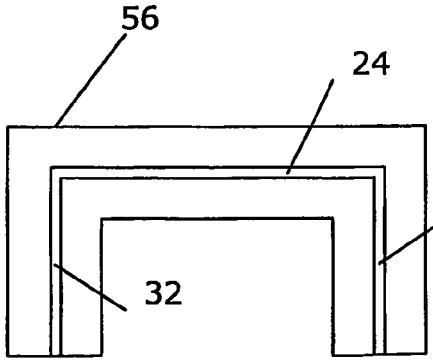
Figure 9:
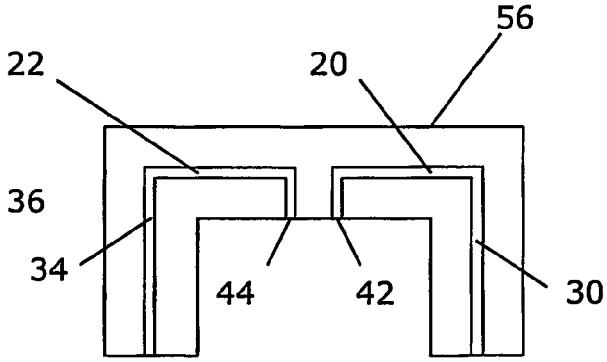

FIG. 8 shows a top view of one such component, while FIG. 9 shows a bottom view of this component. The antenna structure shown in the figures is the same structure that was showed in FIG. 2. It should however be realised that the other types of structures mentioned above are also feasible. The component includes a dielectric material 38 having a U-shape, which on its top side includes the third, seventh and ninth sections 24, 32, 36 and on its bottom side includes the first, second, sixth and eighth sections 20, 22, 30 and 34. The fourth and fifth sections are placed on the short sides of the two legs of the U (not shown). The first feeding end 42 of the first section 20 and the second feeding end 44 of the second section 22 are then to be placed and soldered to a suitable part of a PCB. The sections are preferably placed on the dielectric material by etching, although alternative methods can of course be used.

The present invention has been described in relation to a headset, it should be realised that this is just one device in which the present invention can be provided. Therefore the present invention is only to be limited by the following claims.

The invention claimed is:

1. Wireless communication device comprising:

a loop antenna element including, a first section provided in and extending a length in a first plane, a second section spaced from the first section and provided in and extending a length in the first plane, where the second section extends along the same line as the first section or has a curvature which is a continuation of the curvature of the first section, a third continuous section provided in a second plane essentially parallel to the first plane and essentially aligned with the first and second sections wherein a length of the third continuous section is at least as great as combined lengths of the first and second sections, a fourth and a fifth section interconnecting antenna sections provided in the first and second planes, wherein the antenna sections form a three-dimensional structure having a substantial two-dimensional extension in at least one of the first and second planes, and a printed circuit board including a ground plane and radio circuits for the loop antenna element, wherein the antenna element sections are provided along the sides of and bound by the printed circuit board.

2. Wireless communication device according to claim 1, wherein portions of the three- dimensional antenna structure in the first plane at least partly enclose an area in the first plane where a component can be placed so that portions of the three-dimensional antenna structure in the first plane are on opposite sides of the area in the first plane where the component can be placed.

3. Wireless communication device according to claim 1 wherein antenna sections in the first and second planes extend in more than one direction.

4. Wireless communication device according to claim 1 wherein the first section has a first feeding end and the second section has a second feeding end both provided in the first plane close to each other.

5. Wireless communication device according to claim 1, wherein the loop antenna element is provided along at least half of the perimeter of the printed circuit board.

6. Wireless communication device according to claim 1 wherein the antenna sections are provided in the form of metallic strips, wires or a combination of both.

7. Wireless communication device comprising:

a loop antenna element including, a first section provided in and extending a length in a first plane, a second section spaced from the first section and provided in and extending a length in the first plane, where the second section extends along the same line as the first section or has a curvature which is a continuation of the curvature of the first section, a third section provided in a second plane essentially parallel to the first plane and essentially aligned with the first and second sections, a fourth and a fifth section interconnecting antenna sections provided in the first and second planes, and a sixth and a seventh antenna section essentially aligned with each other and provided in the first and the second plane, respectively, where the sixth and seventh sections are generally perpendicular to at least parts of and connected to the first and third section, respectively, wherein the antenna sections form a three-dimensional structure having a substantial two-dimensional extension in at least one of the first and second planes.

8. Wireless communication device according to claim 7, wherein the fourth section interconnects the sixth and seventh section.

9. Wireless communication device according to claim 7 further including an eighth and a ninth antenna section essentially aligned with each other and provided in the first and the second plane, respectively, where the eighth and ninth sections are generally perpendicular to at least parts of and connected to the second and third sections, respectively.

10. Wireless communication device according to claim 9, wherein the fifth section interconnects the seventh and eighth section.

11. Wireless communication device comprising:

a loop antenna element including, a first section provided in and extending a length in a first plane, a second section spaced from the first section and provided in and extending a length in the first plane, where the second section extends along the same line as the first section or has a curvature which is a continuation of the curvature of the first section, a third continuous section provided in a second plane essentially parallel to the first plane and essentially aligned with the first and second sections wherein a length of the third continuous section is at least as great as combined lengths of the first and second sections, and a fourth and a fifth section interconnecting antenna sections provided in the first and second planes, wherein the antenna sections form a three-dimensional structure having a substantial two-dimensional extension in at least one of the first and second planes, wherein a length of the loop antenna element corresponds to a hill wavelength of a center frequency in a desired frequency band.

12. Wireless communication device comprising:

a loop antenna element including, a first section provided in and extending a length in a first plane, a second section spaced from the first section and provided in and extending a length in the first plane, where the second section extends along the same line as the first section or has a curvature which is a continuation of the curvature of the first section, a third section provided in a second plane essentially parallel to the first plane and essentially aligned with the first and second sections, and a fourth and a fifth section interconnecting antenna sections provided in the first and second planes, wherein the antenna sections form a three-dimensional structure having a substantial two-dimensional extension in at least one of the first and second planes; and at least one passive antenna element in a third plane parallel to the first plane and provided on the other side of the first plane than the second plane for providing a resonating circuit or tuning element for the loop antenna.

13. Wireless communication device comprising:

a loop antenna element including, a first section provided in and extending a length in a first plane, a second section spaced from the first section and provided in and extending a length in the first plane, where the second section extends along the same line as the first section or has a curvature which is a continuation of the curvature of the first section, a third continuous section provided in a second plane essentially parallel to the first plane and essentially aligned with the first and second sections wherein a length of the third continuous section is at least as great as combined lengths of the first and second sections, and a fourth and a fifth section interconnecting antenna sections provided in the first and second planes, wherein the antenna sections form a three-dimensional structure having a substantial two-dimensional extension in at least one of the first and second planes, wherein the device is a portable communication device, wherein the portable communication device is a headset.

14. Antenna arrangement for a wireless communication device comprising:

a first section provided in and extending a length in a first plane, a second section spaced from the first section and provided in and extending a length in the first plane, where the second section extends along the same line as the first section or has a curvature which is a continuation of the curvature of the first section, a third continuous section provided in a second plane essentially parallel to the first plane and essentially aligned with the first and second sections wherein a length of the third continuous section is at least as great as combined lengths of the first and second sections, a fourth and a fifth section interconnecting antenna sections provided in the first and second planes, wherein the antenna sections form a three-dimensional structure having a substantial two-dimensional extension in at least one of the first and second planes; and a dielectric material on which the sections of the antenna element are provided, in order to produce a component that can be mounted on a printed circuit board.

15. Antenna arrangement according to claim 14, wherein portions of the three-dimensional structure in the first plane at least partly enclose an area in the first plane where a component can be placed so that portions of the three-dimensional antenna structure in the first plane are on opposite sides of the area in the first plane where the component can be placed.

* * * * *